US005429451A

United States Patent [19]

Pettee, Jr.

[11] Patent Number: 5,429,451

[45] Date of Patent: Jul. 4, 1995

[54] GRID MATRIX SYSTEM INCLUDING INTERCONNECTED REVETMENT BLOCKS

[76] Inventor: Gary K. Pettee, Jr., 833 Village Quarter Rd. - Unit G6, West Dundee, Ill. 60118

[21] Appl. No.: 56,309

[22] Filed: Apr. 30, 1993

[51] Int. Cl.[6] ..... E02B 3/12

[52] U.S. Cl. ..... 405/20; 405/16; 405/17; 404/41

[58] Field of Search ..... 405/16, 17, 20; 404/41, 404/37, 38, 39, 35, 40; 52/609, 611

[56] References Cited

U.S. PATENT DOCUMENTS

| | | | |
|---|---|---|---|
| 3,168 | 7/1843 | Terry | 404/41 |
| 3,310,906 | 3/1967 | Glukes | 405/16 X |
| 3,903,702 | 9/1975 | Appleton . | |
| 4,227,829 | 10/1980 | Landry, Jr. | 405/20 |
| 4,370,075 | 1/1983 | Scales | 405/20 |
| 4,372,705 | 2/1983 | Atkinson | 405/19 |
| 4,465,398 | 8/1984 | Knudsen | 405/20 X |
| 4,875,803 | 10/1989 | Scales | 405/16 |
| 5,035,532 | 7/1991 | Gargollo | 404/41 |

FOREIGN PATENT DOCUMENTS

| | | | |
|---|---|---|---|
| 2123523 | 11/1972 | Germany | 405/20 |
| 891522 | 3/1962 | United Kingdom | 404/41 |

OTHER PUBLICATIONS

Hydro-Turf & Assoc., Inc. 4-page brochure entitled "Conlock World's Most Advanced Versatile Economical Precast, Concrete Interlocking Erosion Control System".

Protec 10-page brochure.

Amorloc 3510 2-page brochure.

4-page "Flexblock" brochure by Dynoflex of Georgia.

*Primary Examiner*—Dennis L. Taylor

*Attorney, Agent, or Firm*—Rudnick & Wolfe

[57] ABSTRACT

An interlocking grid matrix system is adapted for placement over terrain for use as a revetment. The grid matrix system includes a plurality of substantially identical revetment blocks which are interconnected to allow for omnidirectional movements relative to each other. Each revetment block includes a precast grid body having a first major surface, a second major surface, and an edge extending between the major surfaces to define a periphery for the grid body. The grid body further includes a plurality of spaced ears which are joined to and extend from the edge and a plurality of locking channels disposed inwardly of the edge between the ears. Each channel opens to each major surface and the edge and is specifically configured to releasably interlock with an ear of an adjacent grid body such that movement in any direction is permitted between adjacent revetment blocks while maintaining an interlocking relationship therebetween.

18 Claims, 4 Drawing Sheets

GRID MATRIX SYSTEM INCLUDING INTERCONNECTED REVETMENT BLOCKS

FIELD OF THE INVENTION

The present invention generally relates to grid matrix systems of the type used on the sides of rivers, drainage canals and riverbeds and, more particularly, to revetment blocks which are permitted omnidirectional movements relative to each other while maintaining an interlocking relationship between adjacent blocks thereby allowing the grid matrix system to conform to contour changes in the underlying terrain and providing changes in the hydrodynamic interaction of the grid matrix system with substantially identical blocks depending upon their horizontal disposition relative to each other.

BACKGROUND OF THE INVENTION

Soil erosion is a serious problem which commonly results frown water flow at the interface of land and water such as on the side of a riverbed or the like. Soil erosion can also result from rainfall as it proceeds through a basin or the like which typically empties into a river.

Trees, grass and other forms of vegetation and the like naturally inhibit erosion. The root systems of the grass, vegetation and the like serve to consolidate the underlying soil and prevent soil erosion. It is common, however, that areas where water is continually flowing are subject to relatively high hydraulic load applications and the natural methods of inhibiting soil erosion will not always suffice. Many times, vegetation growth cannot be accomplished quickly enough to prevent erosion.

Various revetment systems have been used to augment or replace vegetation as an erosion barrier. In one form, a loose revetment barrier is typically accomplished by dumping large non-uniform chunks of concrete over an area. Relative high hydrodynamic forces acting on these revetment systems are generated by the flow of a river over the concrete chunks. A shear force acts in the direction of river flow over the revetment. A lift force acts generally perpendicular. Because the chunks of concrete are of non-uniform or random size, it is often difficult to determine the hydrodynamic aspects to counteract such forces acting against the revetment, thus detracting from an engineered system. Moreover, the concrete chunks commonly used are of random size and therefore complicate the engineered hydrodynamic interaction and static of the system.

Soil erosion prevention blocks and other revetment blocks are well known in the art. In one form, a plurality of erosion blocks are strung together as by cables laced through the blocks to form a mat of concrete. These known mats of strung-together concrete blocks are expensive. The difficulty and cost of installation of such mats also weigh against this type of system.

The permeability, static friction, dynamic friction, surface roughness, and weight per square foot of such grid matrix systems are important engineering concerns to inhibiting displacement of the blocks under the influence of the hydrodynamic loading of the river or waters flowing thereover, and to a limited degree thereunder. Thus, the need to adjust the permeability, and surface roughness of such systems as well as the weight per square foot has heretofore required different revetment block designs to be used and intermixed in the grid matrix system. A mixture of different blocks with specificity increases the cost and complicates the establishment of a grid matrix system.

Today's revetment blocks cover a predetermined area and provide a predetermined static force which counters the hydraulic forces tending to move the blocks as the river waters pass thereover. The level of static force required and opposition to hydraulic uplift determines the size of the block to be used in a particular area of the grid matrix system. Again, different portions of the grid matrix system may require different block designs depending upon the particular hydraulic loads to be encountered in that portion of the system. As mentioned above, using different block designs complicates the overall design and furthermore increases the cost of the project.

Inhibiting the revetment blocks from moving relative to each other has resulted in revetment blocks which interconnect or interlock relative to each other. Heretofore known revetment blocks which interconnect with each other, however, are not provided with the ability to likewise easily adjust to changing ground contours. As will be appreciated, along an extensive length of a river or other waterway, the terrain over which the grid matrix system is arranged has a continuously changing ground contour. Thus, to accommodate the changes, the interlocking connections between the blocks have been broken off or dislocated thereby allowing the blocks to adjust to the changing ground contours. Of course, breaking off the interconnections defeats the ability of the blocks to interconnect and thus reverts to the problem of the blocks being displaced relative to each other or hydraulically undermined as a result of the hydraulic forces acting on the blocks.

Thus, there is a need and a desire for articulate revetment blocks which can be interconnected relative to each other to form a grid matrix system wherein the weight per square foot, static friction and surface roughness of the matrix system can be economically varied, as well as having the ability to modify the permeability of the system to accommodate specific requirements of different portions of the system.

SUMMARY OF THE INVENTION

In view of the above, and in accordance with the present invention, there is provided an interlocking grid matrix system adapted for placement over terrain for use as a revetment. The grid matrix system of the present invention includes a plurality of substantially identical revetment blocks which are interconnected to allow for omnidirectional movements relative to each other. Each revetment block includes a precast grid body having a first major surface, a second major surface, and an edge extending between the major surfaces to define a periphery for the grid body. The grid body further includes a plurality of spaced ears which are joined to and extend from the edge and a plurality of locking channels disposed inwardly of the edge between the ears. Each channel opens to each major surface and the edge and is specifically configured to releasably interlock with an ear of an adjacent grid body such that movement in any direction is permitted between adjacent revetment blocks while maintaining an interlocking relationship therebetween.

In the illustrated embodiment, the first major surface of each revetment block constitutes a top surface for the block while the second major surface of each revetment block constitutes a bottom surface of the block. Likewise, each ear of the grid body includes first and second major surfaces which extend generally planar with the first and second major surfaces of the grid body.

The grid body is preferably precast to provide each channel with a generally C-shaped planar cross-sectional configuration defining an ingress opening through which a portion of an ear on an adjacent grid body projects. Each locking channel opens to the top and bottom surfaces of the respective grid body to allow an ear of an adjacent revetment block to be vertically slid thereinto to establish a releasable interlocking relationship between adjacent blocks.

In a preferred form of the invention, the grid body is precast to provide each ear with a generally T-shaped planar cross-sectional configuration. More particularly, each ear of the grid body includes a head portion at a terminal end of each ear and a neck portion which rigidly joins the head portion to the grid body. The head portion of each ear slidably fits within a locking channel of an adjacent revetment block and is horizontally movable within predetermined limits therewithin such that adjacent revetment blocks can be adjustably positioned in a horizontal plane relative to each other. The neck portion of each ear fits through the ingress opening to the locking channel. In one form of the invention, the neck portion of each ear includes two substantially vertical walls which engage with two other walls of the grid body defining the ingress opening to the locking channel. In an alternative embodiment, the walls of the neck portion may be vertically slanted to accommodate movement of one revetment block relative to an adjacent revetment block.

In one form of the invention, the periphery of each revetment block has a generally rectangular cross-sectional configuration. Moreover, the rectangularly-shaped revetment block preferably includes two ears projecting from opposite sides thereof and has two locking channels spaced inwardly from the opposite sides of the revetment block. This configuration of the blocks allows them to be slidably interconnected in a rectangular coordinate matrix where the blocks are oriented about 90° relative to each other.

In an alternative form of the invention, the periphery of each block has a generally planar hexagonal cross-sectional configuration. The hexagonal-shaped blocks typically include three ears disposed approximately 120° apart from each other and three locking channels likewise disposed apart by 120° each. The hexagonal shape of these locking blocks allows them to be slidably interconnected in a polar coordinate matrix. In either embodiment, the number of ears provided on each grid body equals the number of locking channels defined by the grid body. The rectangular and hexagonal shaped embodiments allow the blocks to be set in close proximity to each other without exhibiting any large openings between the edges of adjacent revetment blocks (as would not be the case with a round or eight sided block) thereby permeability and surface roughness to be minimized and the weight per foot of the grid matrix to be maximized when so desired.

A salient feature of the present invention concerns the provision of a grid matrix system having revetment blocks which are both horizontally movable and angularly displaceable relative to each other while maintaining an interlocking relationship therebetween. The ability of the revetment blocks to be interconnected in horizontally varied relation relative to each other allows the permeability or openings between adjacent blocks to be readily modified as they are laid to form the grid matrix system. In this regard, in a preferred form of the invention, the grid blocks are laid over a screen mesh disposed between the bottom surfaces of the blocks and the terrain. Moreover, in a preferred form of the invention, the grid blocks are formed from precast concrete. Thus, different horizontal spacings between adjacent blocks provides different surface roughness characteristics along the top surface of the grid matrix systems thereby adding to the ability of this system to effect energy dissipation and thereby control water flow. The ability to vary the openings between the blocks while maintaining an interconnection therebetween allows engineers to control block stability by varying the permeability, static friction, relative surface roughness and weight per square foot of the grid matrix system. Thus, identical blocks may be used in varying horizontal placements relative to each other rather than requiting several different block designs to accommodate different open areas.

In addition to the interconnection between the blocks allowing for horizontal adjustability between adjacent revetment blocks, the interconnection between the blocks furthermore allows the bottom surface of one block to be angularly displaced relative to the bottom surface of an adjacent block while maintaining an interconnection between the blocks. The ability to be horizontally movable and angularly displaced simultaneously in all directions provides omnidirectional terrain contouring, i.e., over depressions, domes, and the like. The interconnection between the blocks allows force transfer therebetween thus inhibiting displacement of the blocks relative to each other and yet permits the grid matrix system to conform to changing ground contours without destroying the interlocking relationship between the blocks. This is important to allow the grid matrix system to accommodate changes or curves in the riverbed as well as changing ground contours.

Numerous other features and advantages of the present invention will be made apparent from the following description of the drawings, the detailed description and the appended claims.

DETAILED DESCRIPTION OF THE PRESENT INVENTION

Figure 1:
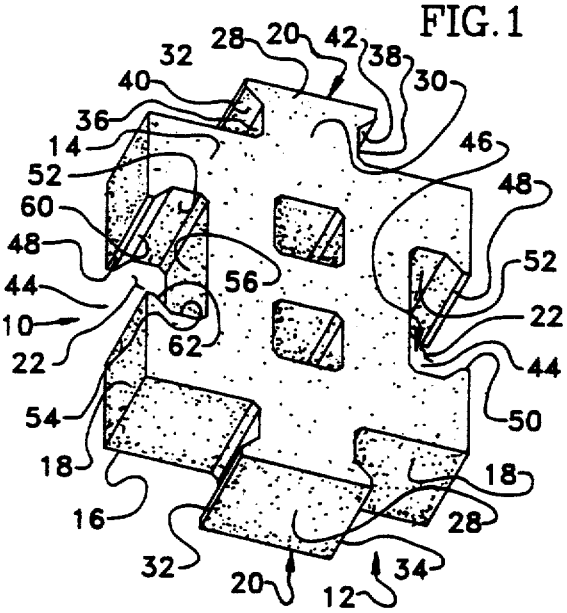
FIG. 1 is an enlarged perspective view of one embodiment of a revetment block according to the present invention.

While the present invention is susceptible of embodiment in various forms, there are shown in the drawings two presently preferred embodiments hereinafter described, with the understanding that the present disclosure is to be considered as setting forth exemplifications of the invention which are not intended to limit the invention to the specific embodiments illustrated.

Referring now to the drawings, wherein like reference numerals refer to like parts throughout the several views, there is shown in FIG. 1 a revetment block which is illustrated in its entirety by reference numeral 10. The revetment block 10 is comprised of a precast grid body 12 which is preferably constructed of concrete because of its cost and availability and because of the function the revetment block is to perform. It should be appreciated, however, that any moldable high density material would suffice.

The grid body 12 includes a first major or top surface 14, a second major or bottom surface 16 and an edge 18 extending between surfaces 14 and 16, respectively, to define a perimeter for the grid body 12. The surfaces 14, 16 and edge 18 are substantially flat in construction, with the surfaces 14 and 16 being illustrated as generally planar and extending generally parallel relative to each other. The preferred planar configuration of surface 14 will reduce the drag (tractive shear) created by incident parallel water flow thereover. The preferred planar configuration of surface 16 will maximize the restrictive shear traction of each block 10 thus enhancing the revetment block design. It should be appreciated, however, that surfaces 14, 16 and edge 18 may have variations in contour from that shown without departing from the spirit and scope of the present invention.

The grid body 12 further includes a plurality of spaced ears 20 and a plurality of locking channels 22. Each ear 20 on body 12 is of substantially similar construction. Thus, only one ear 20 will be described in detail with the understanding that the other ears are similarly constructed. Similarly, each locking channel 22 on body 12 is of substantially similar construction. Thus, only one locking channel will be described in detail with the understanding that the other locking channels are substantially similar.

Each locking ear 20 includes top and bottom surfaces 24 and 26, respectively. In the preferred embodiment, the top and bottom surfaces 24 and 26, respectively, extend generally co-planar with the top and bottom surfaces 14 and 16 of the grid body 12. The grid body 12 is precast to provide each ear with a generally T-shaped planar cross sectional configuration and to integrally connect each ear to the grid body 12. More particularly, each ear 20 is configured with a head portion 28 at a terminal end of each ear and a neck portion 30 which rigidly joins the head portion to the grid body 12. Each head portion 28 includes a pair of sidewalls 32 and 34 which extend between the top and bottom surfaces 24 and 26 of each ear 20 and are spaced apart a predetermined first distance. The neck portion 30 of each ear 20 likewise includes a pair of sidewalls 36 and 38 which span the distance separating the top and bottom surfaces 24 and 26 of each ear 20 and are spaced apart a predetermined second distance, wherein the predetermined second distance is less than the predetermined first distance which separates the sidewalls 32 and 34 of the head portion 28. In the illustrated embodiment, angled surfaces 40 and 42 span the distance separating the top and bottom surfaces 24, 26, respectively, of each ear and serve to join the sidewalls 32 and 34 of head portion 28 with the sidewalls 36 and 38, respectively, of the neck portion of each ear.

Each locking channel 22 is disposed between two ears 20 and inwardly of the edge 18 of the grid body 12. Each channel 22 opens to the surfaces 14 and 16 of grid body 12 and is specifically configured to releasably interlock with an ear 20 of an adjacent grid body. The grid body 12 is precast to provide each locking channel 22 with a generally C-shaped planar cross sectional configuration. In the illustrated embodiment, each locking channel 22 has an ingress opening 44 which opens to a socket opening 46. The ingress opening 44 is defined by a pair of walls 48 and 50 which extend between surfaces 14 and 16 of grid body 12. Notably, walls 48 and 50 are spaced apart a predetermined third distance; wherein the third distance is equal to or slightly larger than the second distance separating the sidewalls 36 and 38 of the neck portion 30 of each ear 20 but is less than the first predetermined distance separating the side walls 32 and 34 of head portion 28 of each ear. Thus, the head portion 28 cannot inadvertently be separated from an adjacent block as a result of horizontal movement therebetween, and an interlocking relationship is maintained between the adjacent blocks.

The socket opening 46 includes a pair of walls 52 and 54 which extend inwardly from the ingress opening 44 defined by the grid body 12 and which are joined by a rear wall 56. Each wall 52, 54 and 56 spans the distance separating surfaces 14 and 16 of each grid body 12. Notably, walls 52 and 54 of socket opening 46 are spaced apart a predetermined fourth distance; wherein the fourth distance is greater than the third distance of the ingress opening 44 and is substantially equal to or slightly greater than the predetermined first distance separating the sidewalls 30, 32 of the head portion 28 of each ear 20. Moreover, the walls 52 and 54 extend inwardly from the respective ingress opening 44 for a distance greater than the thickness of the head portion 28 on each ear such that the ear 20 can move horizontally endwise within a respective locking channel 22 while maintaining an interlocked relationship between adjacent revetment blocks as will be discussed in more detail below.

In the illustrated embodiment, each locking channel 22 further includes angled surfaces 60 and 62 which span the vertical distance separating the top and bottom surfaces 24 and 26, respectively, of each grid body. Angled surfaces 60 and 62 serve to join the walls 48 and 50 defining the ingress opening 44 with walls 52 and 54, respectively, defining the socket opening 46.

Angled surfaces 60 and 62 on the locking channel generally conform and match the angled surfaces 40 and 42 on the locking ear 20 of an adjacent revetment block. By having the surfaces on the locking channel conform with the surfaces of the locking ear, there is increased surface area contact between the locking channel and the locking ear when the blocks are horizontally spread apart as far as possible. The increased surface area contact minimizes point loading and thereby inhibits chipping and breakage.

Figure 2:
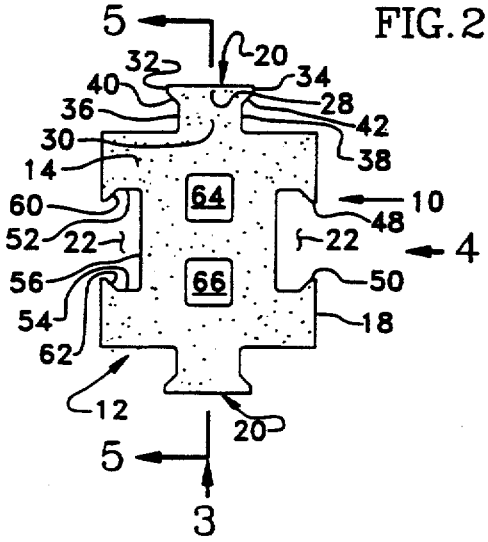
FIG. 2 is a top plan view of the revetment block shown in FIG. 1.
Figure 5:
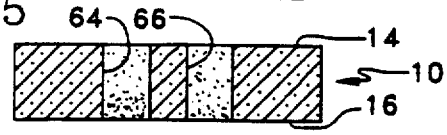
FIG. 5 is a longitudinal sectional view taken along line 5—5 of FIG. 2.
Figure 16:
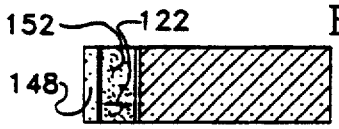
FIG. 16 is a longitudinal sectional view taken along line 16—16 of FIG. 13.

As shown in FIGS. 1, 2 and 5, the grid body 12 may further include openings 64 and 66. As it will be appreciated by those skilled in the art, the size of the opening 64 and 66 will facilitate the permeability of the grid matrix system and/or vegetation requirements.

The revetment block 10 schematically illustrated in FIGURES I through 5 includes two ears 20 arranged generally 180° apart from each other and two locking channels 22 provided generally 180° apart from each other. The ears 20 extend away from the edge 18 of the grid body 12 and are diametrically opposed from each other. Similarly, the locking channels 22 are diametrically opposed from each other. Notably, a locking channel 22 is provided between each pair of ears 20. With the present invention, the number of ears 20 provided on each grid body 12 normally equals the number of locking channels 22 defined by the grid body 12. Moreover, the periphery of the revetment block 10 illustrated in FIGS. 1 through 5 has a generally rectangular planar cross-sectional configuration.

Figure 6:
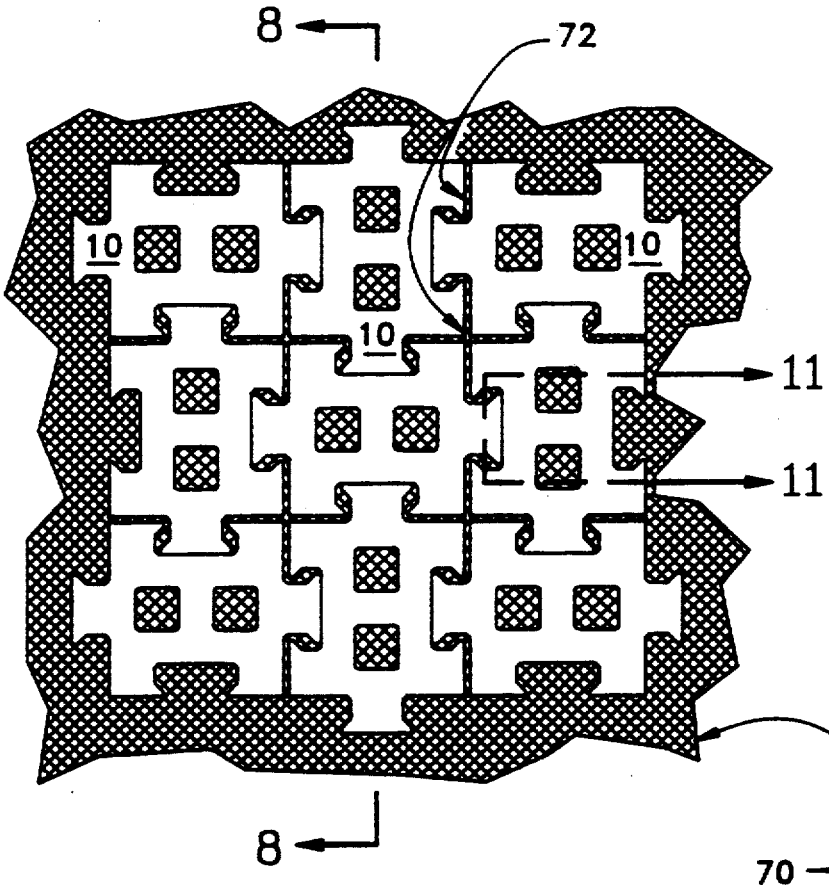
FIG. 6 is a top plan view of an interlocking grid matrix system formed from a plurality of revetment blocks similar to those shown in FIG. 2 arranged with the revetment blocks in a closely spaced relation relative to each other and over a screen mesh.

Turning to FIG. 6, the revetment blocks 10 illustrated in FIG. 1 are slidably interconnected in a rectangular coordinate matrix where adjacent blocks are oriented 90° relative to each other. As shown in FIG. 6, the revetment blocks are slidably joined to each other to form an interlocking grid matrix system or assembly. The grid matrix system or assembly may further include a screen mesh 70 which lies between bottom surfaces of the revetment blocks 10 and the terrain over which the grid matrix is arranged. The screen mesh 70 may be of the type sold by Synthetic Industries, Construction Products Division, in Chattanooga, Tenn., as nonwoven product style number 801 or any other suitable geotechnical filtration fabric or a natural particle filter.

In FIG. 6, adjacent revetment blocks are schematically arranged in closely-spaced horizontal relation relative to each other. Returning to FIGS. 1 and 2, when the revetment blocks are cast, a distal end of each ear 20 is arranged a predetermined fifth distance away from the edge 18 of the block and the back wall 56 of each locking channel 22 is disposed a predetermined sixth distance inwardly from the edge 18. The fifth and sixth distances defined on each grid body are dimensioned such that when the distal end of the ear 20 of one revetment block abuts against the rear wall 56 of the locking channel 22 of an adjacent revetment block, a predetermined-sized opening 72 is provided between the edges 18 of adjacent revetment blocks of the grid matrix system.

Figure 7:
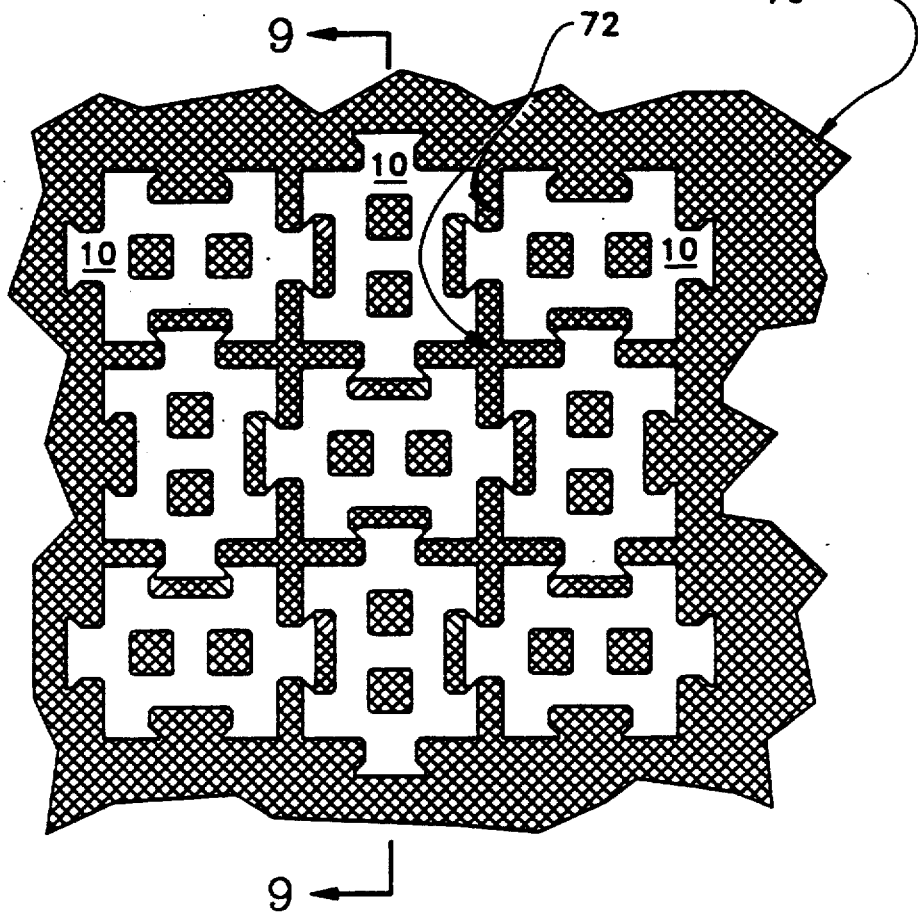
FIG. 7 is a top plan view similar to FIG. 6 but showing the revetment blocks in horizontally spaced relation relative to each other.

As schematically represented in FIG. 7, the open area 72 defined between the edges of adjacent revetment blocks can be modified by horizontally positioning the ear 20 of one revetment block within the locking channel 22 of an adjacent revetment block. Notably, the ear 20 of one revetment block combines with the locking channel 22 of an adjacent revetment block to define predetermined limits of horizontal movement between the revetment blocks. Moreover, it is important to note, that notwithstanding the horizontal position of the blocks relative to each other, a locking interrelationship is maintained between the blocks by the ears 20 being confined within the limits of the locking channels 22.

Figure 8:
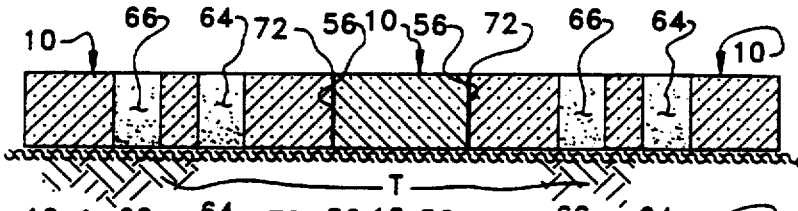
FIG. 8 is a sectional view through the grid matrix system taken along line 8—8 of FIG. 6.
Figure 9:
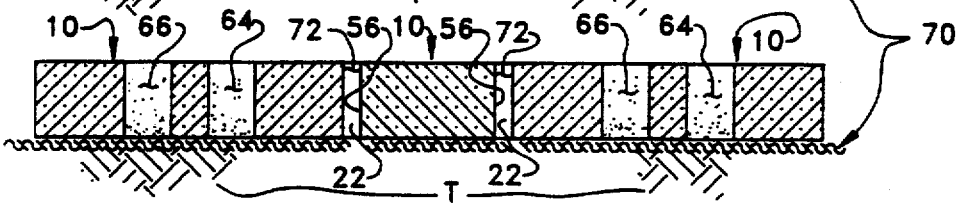
FIG. 9 is a sectional view of the grid matrix system taken along line 9—9 of FIG. 7.

A comparison of FIGS. 8 and 9 further illustrates the difference in the size openings 72 which can be achieved between adjacent edges of the blocks depending upon the horizontal disposition of the blocks relative to each other. As shown in FIG. 8, when the blocks are arranged in close horizontal proximity to each other, the openings 72 between edges 18 of adjacent blocks is relatively small. Thus, the weight per square foot on the underlying terrain T is enhanced when the revetment blocks 10 are arranged in close proximity to each other. Turning to FIG. 9, the openings between adjacent edges of the blocks can be increased when the ear 20 slides within the locking channel 22 while maintaining an interlocking relationship between adjacent revetment blocks. Moreover, the permeability of the arrangement shown in FIG. 9 is enhanced and the coverage provided by adjacent blocks is increased although the same identical blocks are used as that in FIG. 8.

Figure 10:
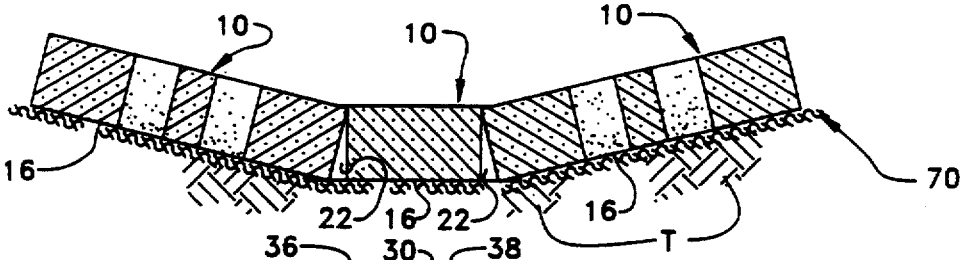
FIG. 10 is a sectional view similar to FIG. 9 but showing a grid matrix system disposed over terrain having changing ground contours.

Turning to FIG. 10, besides being horizontally shiftable within a locking channel and while maintaining an interlocked relationship therewith, the head portion 28 of a revetment block 10 is permitted to vertically articulate within the locking channel of an adjacent revetment block. Accordingly, the bottom surfaces 16 of adjacent revetment blocks 10 may be angularly displaced relative to each other thus allowing the grid matrix system to conform to the changing contours of the underlying terrain T.

Figure 11:
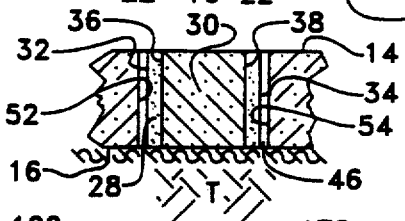
FIG. 11 is a sectional view taken along line 11—11 of FIG. 6.

As illustrated in FIG. 11, the spacing between walls 52 and 54 of socket opening 46 is somewhat greater than the distance separating the side walls 32 and 34 of the head portion 28. Thus, an adjacent revetment block may twist to a limited degree within the socket opening 46 thus furthermore allowing the grid matrix system to conform to changes in the contour of the underlying terrain T.

A second embodiment of a revetment block is illustrated in FIGS. 12 through 16 and is designated in its entirety by reference numeral 100. The revetment block 100 is constructed similarly, and functions in a similar manner, to the first revetment block embodiment described above. The elements of this second embodiment of the revetment block that are identical or analogous to those of the first embodiment of the revetment block 10 are designated by reference numerals similar to those used above but are in the 100 series.

The revetment block 100 is comprised of a precast grid body 112 including a top surface 114, a bottom surface 116, and an outer edge 118 extending between surfaces 114 and 116 to define a perimeter for the grid body 112. As discussed above, surfaces 114 and 116 are configured to enhance the ability of the interconnected grid matrix system formed from such blocks to favorably react to the hydrostatic forces acting against the blocks as the water flows thereover.

The grid body 112 includes a plurality of spaced ears 120 and a plurality of locking channels 122. Except as described hereinafter, the ears 120 and locking channels 122 are substantially similar to those disclosed in the first embodiment. Suffice it to say, each grid body 112 is precast to provide each ear with a generally T-shaped planar cross-sectional configuration and to integrally connect each ear to the grid body 112. As in the first embodiment, each ear 120 is configured with a head portion 128 at a terminal end of each ear and a neck portion 130 which rigidly joins the head portion 128 to the grid body 112. Each head portion 128 includes a pair of side walls 132 and 134 which extend between the top and bottom surfaces 124 and 126 of each ear 120.

Each locking channel 122 is disposed between two ears 120 and inwardly of the edge 118 of the grid body 112. Each channel 122 opens to the surfaces 114 and 116 of body 112 and is specifically configured to releasably interlock with an ear 120 of an adjacent grid body. The grid body 112 is precast to provide each locking channel 122 with a generally C-shaped planar cross-sectional configuration. In the illustrated embodiment, each locking channel 122 has an ingress opening 144 which opens to a socket opening 146. The ingress opening 144 is defined by a pair of walls 148 and 150 which are spaced apart.

Figure 12:
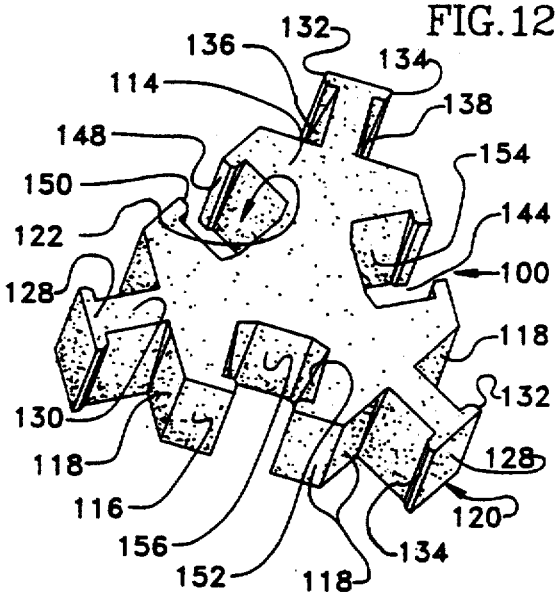
FIG. 12 is an enlarged perspective of a second embodiment of a revetment block.
Figure 13:
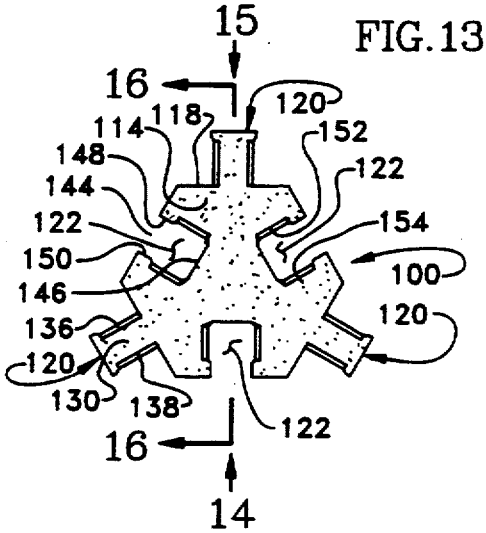
FIG. 13 is a top plan view of the revetment block shown in FIG. 12.
Figure 3:
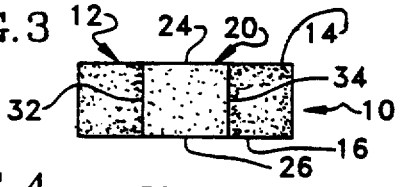
FIG. 3 is an end elevational view of the revetment block shown in FIG. 2.
Figure 14:
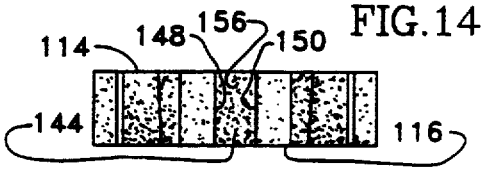
FIG. 14 is an elevational view taken from one end of the revetment block shown in FIG. 13.
Figure 4:
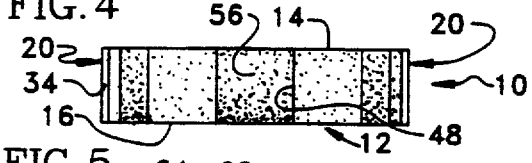
FIG. 4 is a side elevational view of the revetment block shown in FIG. 2.
Figure 15:
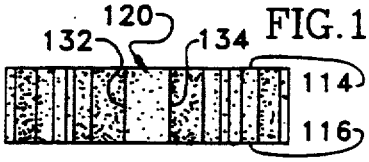
FIG. 15 is an elevational view taken from an opposite end of the revetment block shown in FIG. 13.
Figure 22:
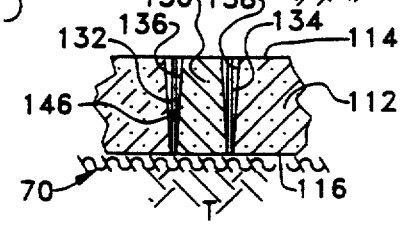
FIG. 22 is an enlarged sectional view taken along line 22—22 of FIG. 17.

As illustrated in FIGS. 12 and 13, the socket opening 146 preferably includes a pair of walls 152 and 154 which extend inwardly from the ingress opening 144 defined by the grid body and which are joined by a rear wall 156. Each wall 152, 154 and 156 spans the distance separating surfaces 114 and 116 of each grid body. Notably, the ingress opening 144 and socket opening 146 are configured to co-act in interlocking engagement with the side walls 132 and 134 of a head portion 128 of each ear 120 and with the neck portion 130 in the manner described with respect to the first embodiment. As schematically represented in FIGS. 12, 13 and 22, the neck portion 130 of each ear 120 includes a pair of side walls 136 and 138 which span the distance separating the top and bottom surfaces 124 and 126 of each ear 120. As best seen in FIG. 22, the walls 136 and 138 angularly converge toward each other as they extend toward the top surface 114 of the grid body 112. The angle or slope provided on the side walls 136 and 138 permit adjacent revetment blocks to articulate relative to each other by allowing room for the neck portion 130 of each ear 120 to twist within the socket opening 146 of an adjacent revetment block.

The walls 152 and 154 of the socket opening 146 of each locking channel may likewise be slanted or sloped in a direction opposed to the angular slope of the walls 136 and 138 of the neck portion 130. The angle or slope provided on the vertical walls 152 and 154 permit adjacent revetment blocks to articulate relative to each other by allowing room for the head portion 128 of an ear 120 to twist within the socket opening 146 of an adjacent revetment block.

The revetment block 100 schematically illustrated in FIGS. 12 and 13 includes three ears 120 arranged approximately 120° apart from each other and three locking channels 122 provided generally 120° apart from each other. Notably, a locking channel 122 is provided between each pair of ears 120. The periphery of the revetment block 100 illustrated in FIGS. 12 and 13 has a generally hexagonal planar cross-sectional configuration.

Figure 17:
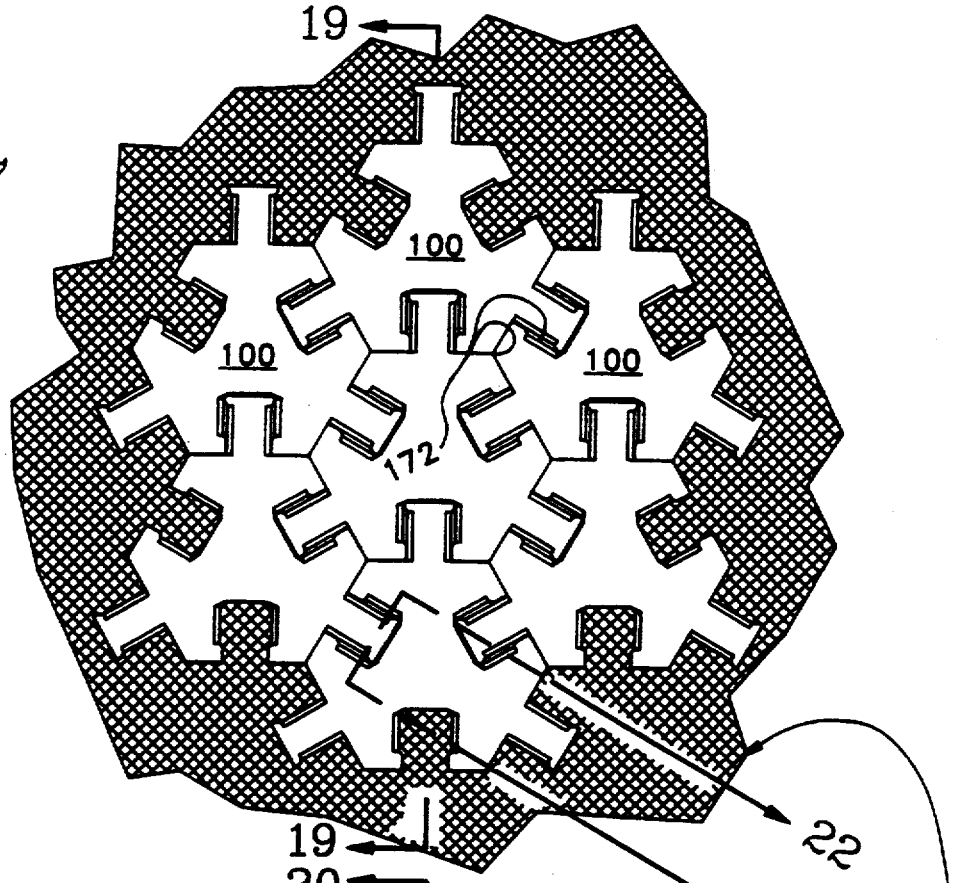
FIG. 17 is a top plan view of a grid matrix system comprised of interlocking revetment blocks similar to those shown in FIG. 12 disposed in closely spaced horizontal relation relative to each other and arranged above a screen mesh.
Figure 18:
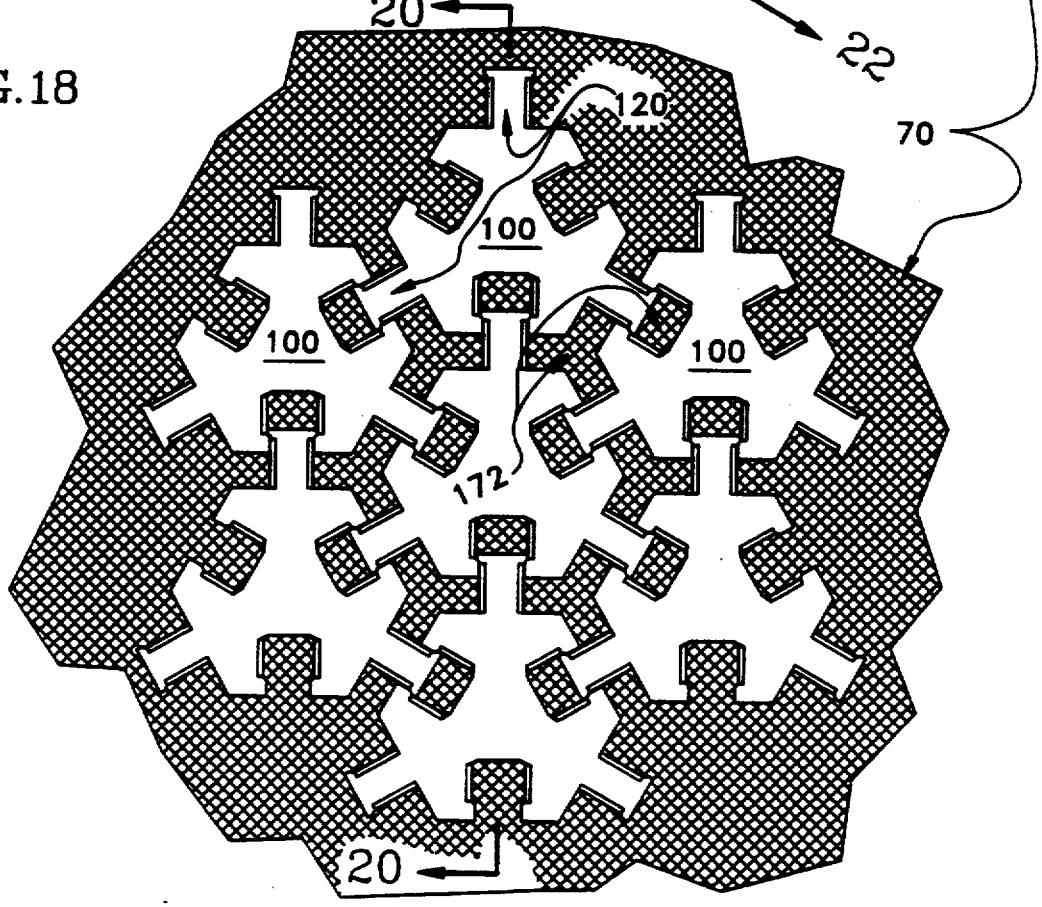
FIG. 18 is a top plan view similar to FIG. 17 but showing the revetment blocks arranged in horizontally spaced relation relative to each other.

Turning to FIG. 17, the revetment blocks 100 illustrated in FIG. 12 are slidably interconnected in a polar coordinate matrix where adjacent blocks are orientated in a different manner compared to those illustrated in FIG. 6. It is important to note, however, that the revetment blocks 100 are slidably joined to each other to form an interlocking grid matrix system or assembly which may further include a screen mesh similar to the numeral 70 discussed above and which lies between bottom surfaces of the revetment blocks 100 and the terrain over which the grid matrix is arranged. In FIG. 17, adjacent revetment blocks are schematically in closely-spaced horizontal relation relative to each other. Thus, the opening areas between edges 118 of adjacent blocks is limited. As schematically represented in FIG. 18, the open area 172 defined between the edges 118 of adjacent revetment blocks can be modified by horizontally positioning the ear 120 of one revetment block within the locking channel 122 of an adjacent revetment block. As with the first embodiment, the ear 120 of one revetment block combines with the locking channel 122 of an adjacent revetment block to define predetermined limits of horizontal movement between adjacent revetment blocks. Moreover, it is important to note, that notwithstanding the horizontal positioning of the blocks relative to each other, a locking interrelationship is maintained between the blocks by the ears 120 being confined within the limits of the locking channels 122.

Figure 19:
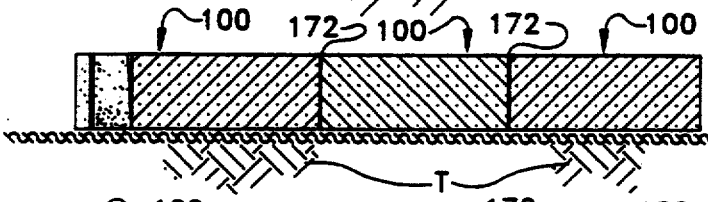
FIG. 19 is a sectional view taken along line 19—19 of FIG. 17.
Figure 20:
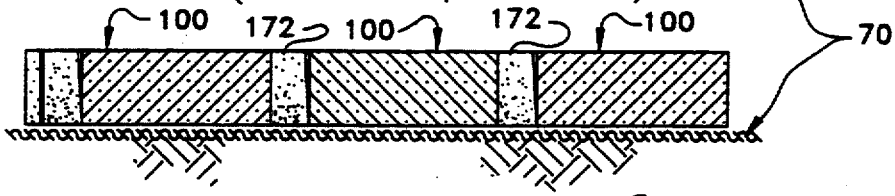
FIG. 20 is a sectional view taken along line 20—20 of FIG. 18.

A comparison of FIGS. 19 and 20 further illustrates the difference in the size openings 172 which can be achieved between adjacent edges of the blocks depending upon the horizontal disposition of the blocks relative to each other. As shown in FIG. 8, when the blocks are arranged in close horizontal proximity to each other, the openings 172 between edges 118 of adjacent blocks is relatively limited. Thus, the weight per square foot on the underlying terrain T is enhanced when the revetment blocks 100 are arranged in close proximity to each other. Turning to FIG. 20, the openings between adjacent edges of the blocks can be increased when the ear 120 slides within the locking channel 122 while maintaining an interlocking relationship between adjacent revetment blocks. Moreover, the permeability of the arrangement shown in FIG. 20 is enhanced and the coverage provided by adjacent blocks is increased although identical blocks are used is that shown in FIG. 19 but with different horizontal spacings therebetween.

Figure 21:
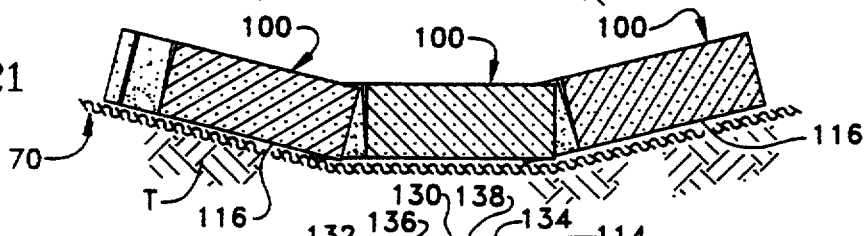
FIG. 21 is a sectional view similar to FIG. 20 showing the grid matrix system arranged over terrain having a changing ground contour.

Turning to FIG. 21, besides being horizontally shiftable within a locking channel and while maintaining an interlocked relationship therewith, the head portion 128 of a revetment block 100 is permitted to articulate within a locking channel of an adjacent revetment block. Accordingly, the bottom surfaces 116 of adjacent revetment blocks 100 may be vertically offset relative to each other thus allowing the grid matrix system formed by said blocks to conform to the changing contours of the underlying terrain T. As will be appreciated, the slanted configuration provided by the walls 152 and 154 of socket opening 146 and the slanted wall configuration 136 and 138 on the neck portion 130 promotes articulated movement of the blocks relative to each other to facilitate the grid matrix system in conforming to changing contours in the underlying terrain.

Irrespective of which block revetment embodiment is used in a grid matrix system, a salient feature of the present invention concerns the ability to omnidirectionally position the revetment blocks relative to each other while maintaining an interlocking relationship between the blocks. The ability of the revetment blocks to be interconnected in horizontally varied relation relative to each other allows the permeability of openings between adjacent blocks to be readily modified as they are laid to form the grid matrix system. The different horizontal spacings between adjacent blocks provides different surface roughness characteristics along the top surface of the grid matrix system thereby adding the ability of this system to effect energy dissipation and thereby control water flow. The ability to control the openings between the blocks while maintaining an interconnection therebetween furthermore allows the amount of backfill required for particular systems to be adjusted as needed by the particular system. The ability to horizontally position the blocks relative to each other while maintaining an interlocking relation therebetween furthermore allows the static weight per square foot to be adjusted as required for the particular embodiments while using identical block designs. Thus, the requirement of a particular revetment design may be facilitated through the use of a common revetment block. Moreover, the ability of the blocks to be horizontally movable and angularly displaced simultaneously in all directions while maintaining an interlocking relationship therebetween provides omnidirectional terrain contouring over domelike protrusions or depressions on the terrain being covered.

From the foregoing, it will be observed that numerous modification and variations can be effected without departing from the true spirit and scope of the novel concept of the present invention. It will be appreciated that the present disclosure is intended to set forth exemplifications of the inventions, and is not intended to limit the invention to the specific embodiments illustrated. The disclosure is intended to cover by the appended claims all such modifications as fall within the spirit and scope of the claims.

What is claimed is:

1. An interlocking grid matrix system adapted for placement over terrain for use as a hydrodynamically interactive revetment, said grid matrix system comprising:

a plurality of substantially identical interlocking revetment blocks; and with each revetment block including a grid body having top and bottom surfaces and defining at least one opening passing between the top and bottom surfaces and with a peripheral vertical edge extending therebetween, each grid body further including a plurality of spaced ears which are rigidly joined to and extend outwardly from the peripheral edge and a plurality of channels disposed inwardly from said edge and between said ears, each ear including an enlarged head portion disposed away from said peripheral edge and a narrowed and elongated neck portion joining the head portion to the grid body, each neck portion having a pair of generally parallel side walls that extend normal to and away from the peripheral wall to provide said neck portion with a generally constant cross-sectional configuration between the peripheral wall and said head portion, each channel defined by said grid body opening to the top and bottom surfaces of the grid body and to the peripheral edge extending therebetween, said grid body being configured to provide each channel with an enlarged socket portion for accommodating the enlarged head portion of an adjacent block therewithin for generally horizontal sliding movement in a generally common plane, said grid body further defining said channel with an inlet portion that is narrower than either the respective socket pocket portion or the head portion of an adjacent block and is defined between and opens to the socket portion and the peripheral edge for slidably accommodating the neck portion of an adjacent block therewithin while maintaining an interlocking relationship between adjacent blocks, and wherein the ears and channels of the interconnected blocks are configured such that greater that a 7% change in ground coverage and system permeability can be accomplished when at least four interconnected revetment blocks are positioned between extreme limits relative to each other, and wherein openings defined by the different horizontal spacings between the blocks effects parallel water flow across the top surface of the grid matrix system.

2. The interlocking grid matrix system according to claim 1 further including a screen mesh disposed between said bottom surfaces of said blocks and said terrain.

3. The interlocking grid matrix system according to claim 1 wherein said revetment blocks are formed from precast concrete.

4. The interlocking grid matrix system according to claim 1 wherein the periphery of said blocks has a generally planar rectangular cross-sectional configuration thereby allowing the blocks to be slidably interconnected in a rectangular coordinate matrix where adjacent blocks are oriented 90° relative to each other.

5. The interlocking grid matrix system according to claim 1 wherein the periphery of said blocks has a generally planar hexagonal cross-sectional configuration thereby allowing the blocks to be slidably interconnected in a polar coordinate matrix.

6. The interlocking grid matrix system according to claim 1 wherein the number of ears provided on each grid body equals the number of locking channels defined by the grid body.

7. The interlocking grid matrix system according to claim 1 wherein each grid body defines two diametrically opposed ears arranged approximately 180° apart from each other and two diametrically opposed locking channels arranged approximately 180° apart from each other.

8. The interlocking grid matrix system according to claim 1 wherein each grid body defines at least three ears arranged approximately 120° apart from each other and three locking channels arranged approximately 120° apart from each other.

9. A revetment block comprising:

a precast grid body having corresponding top and bottom major surfaces and defining at least one opening passing between the top and bottom surfaces with a generally planar peripheral vertical edge extending between said major surfaces, said grid body further including a plurality of identical and spaced ears which are joined to and radially extend from said edge and a plurality of identically shaped channels defined by said grid body and disposed inwardly of said edge between said ears and which open to both major surfaces on the grid body, each ear having an enlarged head portion spaced away from and joined to said body by an elongated and narrowed neck portion, each neck portion having a pair of generally parallel side walls that extend normal to and away from the peripheral edge to provide said neck portion with a generally constant cross-sectional configuration between the peripheral edge and said head portion, said head and neck portions each having top and bottom surfaces disposed at substantially the same elevations as the top and bottom surfaces of the grid body, said grid body being configured to provide each channel with an enlarged socket portion and a narrowed inlet portion, said socket portion having two radially extending sidewalls spaced apart from each other by a distance generally corresponding to the width of the head portion on said ear, said sidewalls of the channel extending generally parallel to each other and are generally parallel to the sidewalls on the neck portion to accommodate horizontally sliding movements of adjacent blocks relative to each other while maintaining an interlocking relationship therebetween and wherein said inlet portion defined by each block opens to the socket portion and to the vertical edge of the grid body to embrace the neck portion of an adjacent block therein and allow extended horizontal movement of the neck portion of the adjacent block therethrough.

10. The revetment block according to claim 9 wherein the grid body is precast to provide each ear with a generally T-shaped planar cross-sectional configuration.

11. The revetment block according to claim 9 wherein said grid body is precast such that the periphery therein has a generally rectangular planar cross-section configuration.

12. The revetment block according to claim 9 wherein said ears and said channels are disposed in a generally orthogonal relationship relative to each other.

13. The revetment block according to claim 9 wherein said grid body is precast such that the periphery therefor has a generally hexagonal planar cross-sectional configuration.

14. An interlocking grid matrix system adapted for placement over a terrain for use as a hydrodynamically interactive revetment over which water flows, said grid matrix system comprising:

a plurality of substantially identical revetment blocks which are interconnected to each other; and with each revetment block including a grid body having corresponding top and bottom surfaces with at least one opening passing therebetween and a generally planar vertical peripheral edge extending therebetween, each grid body further including at least two ears which extend radially outward from and are integrally formed with said body and at least two locking channels defined by said body inwardly of said edge and between said ears, each ear having an enlarged head portion disposed away from the peripheral edge of the grid body and which is joined to said grid body by an elongated and narrowed neck portion, each neck portion having a pair of generally parallel side walls that extend normal to and away from the peripheral edge to provide said neck portion with a substantially constant cross-sectional configuration between the peripheral edge and said head portion, and wherein said grid body is configured to provide each locking channel with an enlarged socket portion which opens to the top and bottom surfaces of the grid body for accommodating the enlarged head portion of an adjacent block therewithin in different positions whereby allowing the peripheral edge of adjacent blocks to be positioned horizontally adjacent relative to each other or in a horizontally spaced generally planar relation relative to each other, said socket portion also opening to a inlet portion which is wider in cross-section than the cross-section of the neck portion of an adjacent portion but narrower than said socket portion and which opens to the top and bottom surfaces and to the peripheral edge of the grid body to establish and maintain a releasable interlocking relationship between the adjacent blocks and to allow an ear of an adjacent block to vertically and articulately move within a respective locking channel while allowing adjacent blocks to conform to changing contours in the underlying terrain, said locking channels and ears being configured such that a greater than 7% change in ground clearance coverage and system permeability between four interconnected revetment blocks can be accomplished when the identical and adjacent revetment blocks are positioned between extreme limits relative to each other thereby allowing the grid matrix system to provide variable weight per square foot coverage to the underlying terrain as a function of the horizontal spacings between adjacent blocks, and wherein the head and neck portions of each ear have top and bottom surfaces disposed at substantially similar elevations to those of the grid body thereby minimizing clearances between the bottom surfaces of adjacent blocks to eliminate water flow therebetween.

15. The interlocking grid matrix system according to claim 14 wherein said head portion has a substantially constant cross-sectional configuration between the top and bottom surfaces and the side edges thereof.

16. The interlocking grid matrix system according to claim 14 wherein said neck portion has top and bottom surfaces and a pair of vertical side walls, and wherein said side walls are vertically slanted between the top and bottom surfaces such that said neck portion has a changing cross sectional thickness between the top and bottom surfaces to promote movement of the head portion of an adjacent block within said locking channel while maintaining an interlocking relation between adjacent blocks.

17. A revetment block comprising:

a precast grid body having corresponding top and bottom surfaces and a generally planar vertical peripheral edge extending therebetween, said grid body further including a plurality of identical ears radially extending from the peripheral edge of the grid body and a plurality of identical channels defined by said grid body and extending inwardly of said peripheral edge between said ears and which open to the top and bottom surfaces of the grid body, each ear having top and bottom surfaces arranged at generally the same elevation as the top and bottom surfaces on the grid body and includes an enlarged head portion joined to said body by an elongated and narrowed neck portion, said neck portion of each ear having two spaced vertical walls radially extending from the peripheral edge between the top and bottom surfaces of the ear, said grid body being configured to provide each channel with an enlarged socket opening and a narrowed inlet opening, with said inlet opening extending between said socket opening and to the peripheral edge of the grid body, and wherein said grid body defines each inlet opening at the peripheral edge of the grid body by two spaced vertical surfaces extending between the top and bottom surfaces of the grid body, and wherein said two vertical spaced walls of at least one of said neck portions and the inlet openings defined by said grid body are angularly disposed in a vertical orientation to promote omni-directional movement of the ear of an adjacent revetment block within said channel while maintaining an interlocking relationship between said adjacent blocks.

18. The revetment block according to claim 17 wherein slanted surfaces are provided on each ear between a distal end of said neck portion and the head portion and between the top and bottom surfaces thereof, and wherein slanted surfaces are defined between the top and bottom surfaces of the grid body between the inlet opening and the socket opening of each channel, and wherein the slanted surfaces on each ear and the slanted surfaces on the grid body minimize point loading between an ear and a channel of adjacent blocks.

* * * * *